United States Patent [19]

Brown et al.

[11] Patent Number: 4,916,279

[45] Date of Patent: Apr. 10, 1990

[54] APPARATUS FOR SURFACE HEATING AN OBJECT BY MICROWAVE ENERGY

[75] Inventors: Richard K. Brown, Hortonville; Thomas D. Pawlowski, Neenah, both of Wis.

[73] Assignee: James River Corporation, Richmond, Va.

[21] Appl. No.: 344,396

[22] Filed: Apr. 28, 1989

[51] Int. Cl.[4] ..... H05B 6/80; B65D 81/34

[52] U.S. Cl. ..... 219/10.55 E; 219/10.55 F; 99/DIG. 14; 426/107; 426/113; 426/234

[58] Field of Search ..... 219/10.55 E, 10.55 F; 99/DIG. 14, 451; 426/107, 113, 114, 241, 243, 234; 126/390

[56] References Cited

U.S. PATENT DOCUMENTS

| | | | |
|---|---|---|---|
| 4,555,605 | 11/1985 | Brown et al. | 219/10.55 E |
| 4,590,349 | 5/1986 | Brown et al. | 219/10.55 E |
| 4,703,148 | 10/1987 | Mikulski et al. | 219/10.55 E |
| 4,713,510 | 12/1987 | Quick et al. | 99/DIG. 14 |
| 4,775,771 | 10/1988 | Pawlowski et al. | 219/10.55 E |
| 4,777,053 | 10/1988 | Tobelmann et al. | 426/113 X |
| 4,780,587 | 10/1988 | Brown | 219/10.55 E |
| 4,785,160 | 11/1988 | Hart | 219/10.55 E |
| 4,794,005 | 12/1988 | Swiontek | 426/107 |
| 4,820,893 | 4/1989 | Mode | 219/10.55 E |

*Primary Examiner*—Philip H. Leung

*Attorney, Agent, or Firm*—Sixbey, Friedman, Leedom & Ferguson

[57] ABSTRACT

An apparatus for surface heating of an object, such as a food object, in an oven by microwave energy which requires only a microwave interactive heater material and a support for it that is designed to obtain higher temperatures via a contact wall formed of stacked layers. In particular, in accordance with various embodiments, a primary panel defines a contact surface against which an object is disposed, and a secondary panel which is coextensive in area with at least an object heating portion of the primary panel is disposed adjacent to the primary panel at an opposite side thereof from the contact surface. Each of the primary panel and secondary panel is formed of a layer of microwave interactive heater material that is applied to a microwave transparent support material, such as paperboard. The layer of heater material applied to the primary panel covers at least the object heating portion thereof, and the layer of microwave interactive heater material applied to the secondary panel covers at least a part of a surface which faces toward the primary panel to an extent that is substantially coextensive with at least the object heating portion of the primary panel.

26 Claims, 4 Drawing Sheets

APPARATUS FOR SURFACE HEATING AN OBJECT BY MICROWAVE ENERGY

DESCRIPTION

I. Technical Field

This invention relates generally to the packaging of food products to be heated in a microwave oven through a direct surface heating effect, in addition to the heating produced by exposure to microwave energy, particularly for crispening or browning of food.

II. Background Art

Attempts to increasingly expand the number and types of prepared foods which can be heated within a microwave oven without losing the desired degree of browning or crisping that such foods normally have when cooked in a conventional oven or stove top implement have led to the development of numerous specialized packages and package components which are designed to achieve microwave browning or crispening of food contained therein. More specifically, these specialized packages incorporate a film or element that will convert microwave energy into thermal energy in order to produce a surface heating effect upon the food which will result in browning and/or crispening thereof.

Typically, the heating film or element is applied directly to an internal wall surface of an outer package body (see, for example, Brown, et al. U.S. Pat. Nos. 4,555,605 and 4,590,349). In other cases, the microwave browning film is applied to a tray contained within the outer package body (see, for example, the noted Brown, et al. U.S. Pat. No. 4,555,605) or to an insert element that is disposed on or under the food object within a tray member located in an outer package body (see, for example, the other Brown, et al. U.S. Pat. No. 4,590,349 and Mikulski, et al. U.S. Pat. No. 4,703,148). Still further, for items which require browning or crispening of multiple surfaces, open-ended sleeves, formed from a unitary paperboard blank that is covered with a microwave interactive heating material and having plural panels hingedly interconnected along fold lines about which the blank is folded, are known for surface heating of a food item inserted therein (see, for example, Brown U.S. Pat. No. 4,780,587 and Pawlowski, et al. U.S. Pat. No. 4,775,771).

Generally, such specialized "cook-in" packaging has served to improve consumer acceptance of a wider range of prepared food products for heating in microwave ovens. However, in many cases, due to the nature of the food object to be heated, a single layer of heater material is unable to achieve high enough temperatures to produce the desired degree of browning and/or crispening of the food object within the time constraints necessary to thoroughly heat the food object without overheating it.

In the case of one embodiment of the Brown, et al. U.S. Pat. No. 4,555,605, a food item is heated within a microwave oven in a pan-shaped tray that has a microwave interactive heating layer affixed on its bottom wall by placing the tray upon the top or top half of a reclosed carton-type outer package, the underside of which may, optionally, have a microwave interactive heating layer joined thereto as well. However, such an arrangement wherein the heating layer on the bottom of a pan is separated from the food object by the wall of the pan itself, and an optional, second interactive heating layer is disposed on the underside of a support surface of a stand created by a carton or carton half is not a suitable solution to the noted problem of a need for higher contact heating temperatures. That is, in such an arrangement the thermal contact heating effects are diminished by the facts that the microwave interactive layer(s) face(s) away from the food object, and both the bottom of the pan-shaped tray and the supporting wall of the carton or carton half produce an insulating effect relative to the transference of heat from the heating layer(s) to the food object.

Furthermore, it has been found that when microwave interactive heating layers are disposed in back-to-back relationship on opposite sides of a board layer, severe scorching of the board layer results. In particular, this scorching problem has been noted in attempts to laminate a microwave interactive layer in back-to-back relationship on the same board layer to produce a heating element which heats to higher temperatures. Likewise, as described in the above-mentioned Brown Pat. No. 4,780,587, a problem of package scorching has also been found to result when a double heater area is created when the ends of a blank are joined to create a sleeve, unless the double heater area is positioned so as to be sufficiently shielded from microwave energy by the food item itself.

Thus, the described scorching problems have caused package manufacturers to find the goal of obtaining a heating apparatus which will heat to a higher temperature than a single layer of microwave interactive heating material elusive. In this regard it is noted that, unlike reuseable implements for conventional and microwave ovens, microwave interactive heating materials of the type used on food packages cannot be preheated prior to use, thereby imposing yet another limitation upon a solution to achieving a contact heating surface which will reach higher temperatures than a single layer.

DISCLOSURE OF THE INVENTION

It is an object of the present invention to provide a novel and improved apparatus for surface heating an object, such as a food product, in a microwave oven wherein the apparatus is capable of achieving higher surface heating temperatures than is possible through the use of a single layer of microwave interactive heater material without scorching or burning of the material upon which it is supported.

It is another object of the present invention to enable a double layer of heater material to be achieved which not only meets the foregoing object, but also minimizes the number of additional pieces required per package.

It is a specific object, in accordance with preferred embodiments of the present invention, to enable one or more stacked layers of heater material to be produced from structural designs formed of a one-piece blank of paperboard material.

Yet another object in accordance with the present invention is to enable double heater material layers to be produced, consistent with the preceding objects, in a manner that is applicable to various forms of microwave interactive heating element apparatus, such as cook-in cartons and sleeves as well as inserts therefor.

Still a further object of the present invention is to provide an improved apparatus for surface heating of an object in a microwave oven via a microwave interactive heater material, wherein the apparatus is formed of a unitary blank which is inexpensive, simple to manufacture, and disposable.

A specific object in accordance with preferred embodiments of the present invention is to provide an apparatus for surface heating of an object in a microwave oven wherein primary and secondary panels, formed by unitary sections of a single paperboard blank upon which a microwave interactive heater material is applied, may be brought into a stacked configuration wherein the primary panel is a contact surface against which the object to be surface heated is disposed and has the microwave interactive heater material applied to at least the object heating portion thereof, and herein the secondary panel is disposed adjacent to the primary panel at an opposite side thereof from the contact surface and with a second layer of the microwave interactive heater material being applied to the secondary panel, covering at least that part of its surface which is directed toward the primary panel so that a stacked arrangement of similar structures results.

Another object of the present invention is to facilitate cost savings through reductions in the amount of microwave interactive heater material and/or paperboard material required through the use of focused patterns of microwave interactive heater material applied to one or more panels of a supporting blank and/or by shaping of a panel to use less supporting board material.

An additional object of the present invention is to enable stacked layers of surface heating panels to be achieved through overlapping of one or more panels of a single blank and securing the panels in overlapping relationship such as by the use of adhesive.

The above and other objects and advantages of the present invention are achieved by preferred embodiments of an apparatus for surface heating an object in an oven by microwave energy which requires only a microwave interactive heating means for surface heating the object by converting microwave energy to heat and a support means for supporting the microwave interactive heating means and for engaging the object to be surface heated by the microwave interactive heating means by virtue of the facts that the support means has at least one contact wall, with a contact surface against which the object is disposed, that is comprised of a primary panel, which defines the contact surface, and a secondary panel, which is coextensive in area with at least an object heating portion of the primary panel and which is disposed adjacent to the primary panel at an opposite side thereof from the contact surface. In this regard, for purposes of this application, the term "object heating portion" is being used to mean that portion of the primary panel of the contact surface that is positioned in sufficient proximity to the object being heated to produce a surface heating browning and/or crispening effect thereon, and the terminology "at least coextensive in area" with the "object heating portion" is being used to indicate an area that, at a minimum, is congruent with the object heating portion, although it may be larger so as to cover additional areas as well.

Moreover, the microwave interactive heating means can comprise a first layer of microwave interactive heater material on the primary panel and a second layer of microwave interactive heater material applied to the secondary panel without producing scorching or burning of the support means. This result is achievable by virtue of the fact that the first layer of heater material is applied to the primary panel so as to cover at least the object heating portion thereof, and the second layer of microwave interactive heater material is applied to the secondary panel so as to cover at least a part of a facing surface thereof that is directed toward the primary panel, the part of the facing surface that is covered by the microwave interactive heater material being substantially coextensive with at least the object heating portion of the primary panel.

Surprisingly, an arrangement, in accordance with the present invention, which possesses the characteristics noted in the preceding paragraph, avoids the scorching and burning problem that has been found to occur when only small portions of similar interactive heater material covered panels are overlapped and the overlap is not positioned to be maximally shielded from microwave energy by the object to be surface heated when the object and apparatus are located in an operative position within a microwave oven.

While the reasons for such success in the face of the failures of somewhat similar structures are not entirely clear, it appears that two characteristics are of particular significance. Firstly, keeping in mind that typical microwave interactive heater material is formed of a metallized plastic laminate wherein a metal layer is deposited upon a plastic film and the metallized film is laminated to a paperboard support material with the metal layer between the plastic film and support material, evidently the sandwiching of the paperboard support material and metal layers between the plastic layers of such a heater material causes too much of the heat generated, upon conversion of the microwave energy into heat by the metallized plastic, becomes trapped between the plastic layers so as to result in severe scorching and burning of the board.

Similarly, it seems that when panels, that are covered with a microwave interactive heater material on like facing sides, are only overlapped to a small extent, scorching and burning also occurs (if the area of overlap is not adequately shielded for microwave energy) because the double layer of interactive heater material at the overlap serves as a focus for the microwave energy and the overlapped layers of heater material convert substantially more microwave energy into heat than can be effectively transferred from them (considering that paperboard and many foods, as well as air, are thermally relatively insulative). As a result, heat builds up in the overlap to the point that severe scorching and burning of the paperboard support material, as well as the food, can occur.

Thus, the present invention seeks to provide an apparatus wherein an undesirable buildup of heat within the support material will be avoided. In particular, the invention ensures that the area of overlap is at least coextensive with the object heating area in order to provide sufficient heat distribution.

Consistent with the foregoing, the preferred embodiments of the present invention form a primary panel and a secondary panel of a surface heating apparatus as unitary sections of a single paperboard blank, each section of the blank being connected to an adjoining section by a fold line, so that the sections forming the primary panel and the secondary panel are disposed relative to each other in a manner enabling them to be brought into a superimposed relationship by folding of the blank about the fold lines. In this manner, the apparatus may be formed into browning and crispening sleeves by folding of the blank so as to bring at least opposite end sections thereof into an overlapping relationship forming one or more double-layered contact walls.

Alternatively, the blank may be comprised of first and second polygonal main wall sections with a side wall section situated at each edge of the first main wall section and with a primary panel forming wall section joined to one of the side wall sections at an edge thereof that is disposed opposite its edge that is joined to the first main wall section. In this case, the blank is erectable into a carton having the first and second main wall sections disposed in facing relationship to each other with the side wall sections extending therebetween to define an object receiving space and with the primary panel wall section being disposed in overlapping relationship to an inner side of one of the wall sections that define the object receiving space so that the primary panel wall section and the wall section overlapped thereby form the primary panel and secondary panel of a surface heating contact wall.

Still further, for those situations wherein a planar surface heating insert is required, the paperboard blank support material may be comprised of an insulating section that is free of microwave interactive material, with sections of the blank that form the primary panel and the secondary panel of the contact wall being connected together with the insulating section in a hinge-like manner by fold line means for enabling the primary panel to be stacked upon the secondary panel at one side of the insulating section. Such a heating element may use sections that have a disk-like shape, and wherein the microwave interactive material completely covers the sections forming the primary and secondary panels on the same side of the blank, the insulating section being connected between the sections forming the primary and secondary panels.

Other and more specific objects, features, and advantages of the present invention will become more apparent from the following "Brief Description of the Drawings" and from the detailed description of the preferred embodiments contained in the description of The "Best Mode for Carrying Out the Invention".

Figure 1:
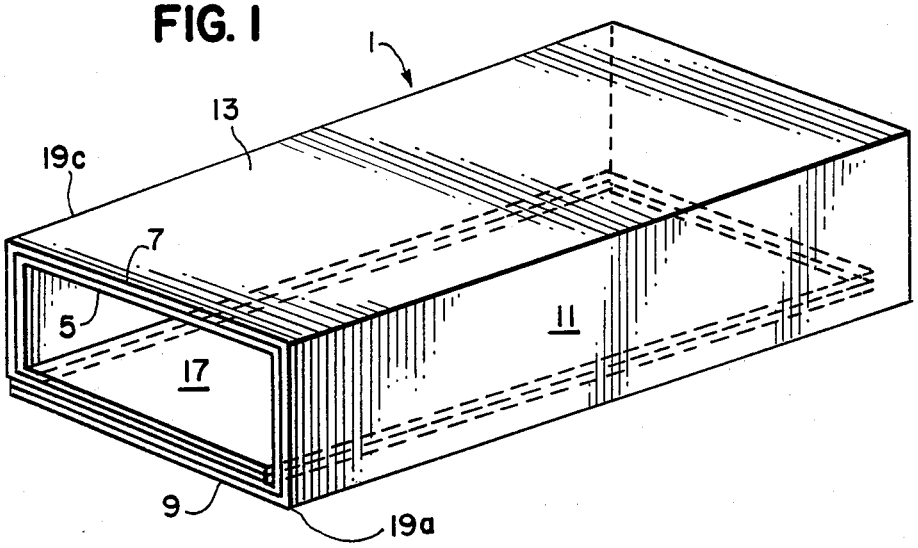
FIG. 1 is a perspective view of an embodiment of a browning sleeve constructed in accordance with a preferred embodiment of the present invention.
Figure 2:
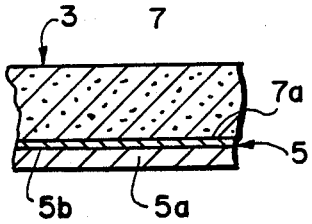
FIG. 2 is an enlarged, broken away cross-sectional view of the material of which the FIG. 1 sleeve is formed.

Throughout the Figures of the drawings, like reference numerals are utilized to designate elements that are the same or similar in various embodiments in order to indicate the correspondence of components of related embodiments but with prime designations (',", etc.) serving to distinguish between such embodiments.

BEST MODE FOR CARRYING OUT THE INVENTION

FIG. 1 illustrates an apparatus for surface heating of an object, such as a food item, in a microwave oven that is in the form of a browning and crispening sleeve of the type described in Brown U.S. Pat. No. 4,780,587 and is normally packaged as an insert (in a collapsed form) within a package of prepared food for shipping, storage, and sale as shown in Pawlowski, et al. U.S. Pat. No. 4,775,771. As for the blanks for the sleeves described in both of these patents, the sleeve 1 of the present invention is formed from a unitary blank 3 (FIG. 3) of microwave transparent material, such as paperboard. Furthermore, as is the case for the blanks of the known sleeves, blank 3 has a layer of microwave interactive heater material 5 on one side. This heater material 5 is comprised of a plastic layer **5*a* upon which a metal film layer 5*b* has been deposited, the metal film layer 5*b* being laminated to a surface 7*a* of the paperboard material 7 of the blank 3**.

Figure 3:
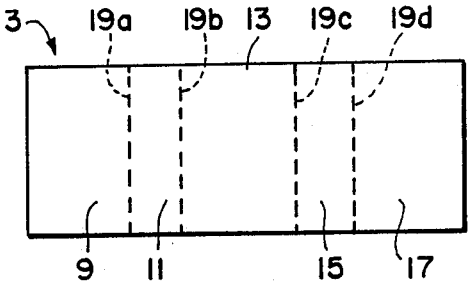
FIG. 3 illustrates an example of a blank from which the FIG. 1 sleeve may be formed in plan view.

In addition, the blank 3 is subdivided into a plurality of sections by fold lines which serve to hingedly interconnect the sections of the blank in a manner which allows it to be folded into an open-ended sleeve of the desired size and configuration, also, in the manner of the known sleeves. A sleeve 1 of the rectangular configuration shown as an illustrative embodiment of the surface heating apparatus of the present application, if constructed in accordance with known techniques, would be formed from a blank having four panels separated by fold lines and would be assembled in a manner causing the opposite end sections to slightly overlap (or an additional attachment flap would be provided) for enabling the opposite ends of the blank to be connected in an end-to-end manner, such as by gluing. However, in contrast, the blank 3, in accordance with the present invention, is subdivided into five sections, 9, 11, 13, 15, 17, by fold lines **19*a*–19*d*, with the first and last sections 9, 17 being of essentially the same size and configuration so that, upon folding of the blank along the fold lines 19*a*–19*d*, the blank is assembled into a sleeve which, as shown in FIGS. 1 and 3, has section 17 superimposed upon section 9** so as to almost totally overlap it.

Figure 4:
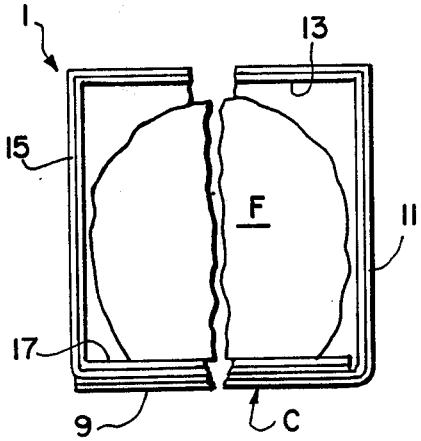
FIG. 4 is a partially broken away end view of the FIG. 1 sleeve with a food object disposed therein for heating within a microwave oven.

It can be appreciated from FIG. 4 that the overlapped sections 9, 17 form a contact wall C having a contact surface against which an object, such as the food item F, is disposed for heating in a microwave oven. The contact surface is defined by the inner surface of section 17, which forms a primary panel of the contact wall C, while the underlying section 9 forms a secondary panel that is coextensive in area with not only the object heating portion of the primary panel, but also the surrounding areas thereof. In addition to the first layer of microwave interactive heater material that is applied over the surface of primary panel section 17, a second layer of microwave interactive material covers the secondary panel section 9 on the facing surface thereof that is directed toward section 17, i.e., stacked layers of paperboard-heater material-paperboard-heater material, are produced.

As fully commented upon in the initial "Description of the Invention," this arrangement surprisingly avoids the scorching and burning problem that has plagued prior attempts to achieve a microwave interactive heating means that will heat to higher temperatures, as well as the scorching and burning problem that has been associated with similar stacked structures that have had only small edge or flap portions of interactive heater material covered panels overlapped. This is, apparently, a result of the fact that heat generated by the layers of heater material does not become trapped between their associated plastic film layers, and since extending the area of overlap, so as to make it at least coextensive with the object heating area of the contact wall, ensures that microwave energy is not focused into an area that is too small to enable effective distribution and transference of the heat produced in the overlapped heater material layers. In fact, as shown by the sleeve 1' of FIG. 5, blank 3 could be extended so as to have additional sections 19, 21 and 23 which results in the food object F being completely surrounded by contact walls formed of overlapped primary and secondary panels. In this regard, it is noted that, for simplicity, these additional overlapped sections 11, 19; 13, 21; and 15, 23 have also been referred to as contact walls due to their possessing the identical structure as the contact wall formed by the overlapped sections 9, 17, even though contact may or may not actually occur to the same extent as occurs for the bottom contact wall, or may not even occur at all (heating then occurring by radiation instead of conduction).

Figure 5:
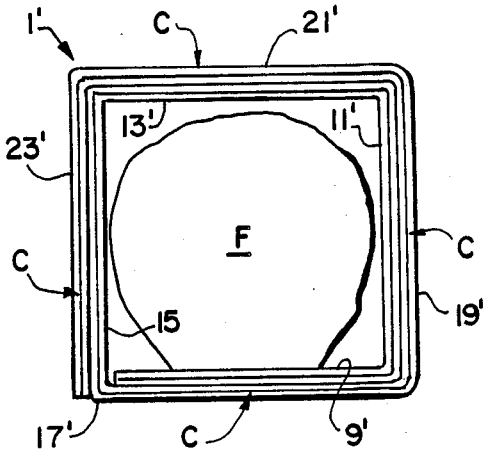
FIG. 5 is a modified end view of a microwave browning sleeve similar to that of FIG. 1, but having an increased number of overlapping wall sections.
Figure 6:
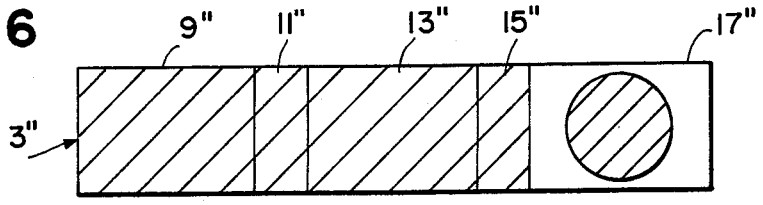
FIG. 6 is a plan view of a modified blank for forming a heating sleeve in accordance with the present invention.
Figure 7:
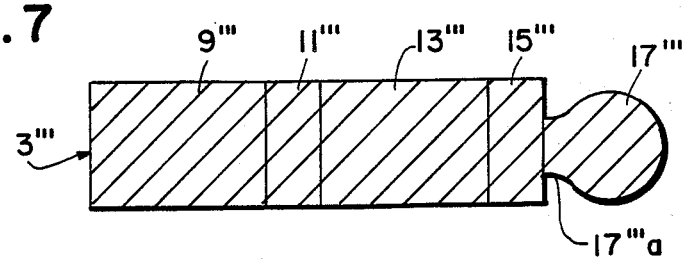
FIG. 7 represents another alternative form for a blank for producing a microwave interactive heating sleeve in accordance with the present invention, in plan view.

As can be appreciated from FIGS. 4 and 5, often times the object heating portion of the primary panel of the contact wall C, formed by the overlapping sections of the blank, has an area that is smaller than the area of the contact wall. As such, economies can be achieved, along with avoidance of unnecessary heat production, by confining the metallization layer of the microwave interactive heating means to the object heating portion of one of the panel sections forming a contact wall C. In FIG. 6, a blank 3'' is shown for producing a sleeve in which the section 17'' is provided with a focused covering of microwave interactive heater material that conforms essentially to the shape of the object heating portion of a contact wall C intended for use with a particular food object F, thereby limiting the amount of heat buildup in the paperboard material 17 by confining the double heater material layers to the minimum area required to produce the desired browning and crispening effect, the microwave energy that, otherwise, would unnecessarily be converted to heat being able to act directly on the food object F. On the other hand, in FIG. 7, a blank 3''' is shown in which the end section 17''' has been given a shape that conforms essentially to the shape of the object heating portion of a contact wall C, except for the provision of a connecting hinge portion 17'''*a* thereof. An arrangement as shown in FIG. 7 is advantageous relative to that of FIG. 6 in that it requires the use of less paperboard and eliminates the need to utilize the more complicated focus metallization technique required to form a panel 17'' as shown in FIG. 6.

Additionally, it should be appreciated from a comparison of FIGS. 4 and 5 that, in assembling a blank 3'', 3''' into a sleeve, the end section 17'', 17''' may be disposed so as to serve as the primary panel of a contact wall C (as in FIG. 4) or as the secondary panel of a contact wall C as in FIG. 5; although, in most cases, it will be preferable to utilize the panel having a smaller area of microwave interactive heater material as the secondary panel of the contact wall, thereby enabling a more effective distribution of heat and less buildup of heat within the paperboard layer disposed between the stacked layers of interactive heater material. It should also be recognized that the techniques shown for panels 17'', 17''' need not be confined to only a single end section, but rather can be utilized, for example, with respect to the panel sections 19', 21' and 23' of the FIG. 5 embodiment.

Figure 8:
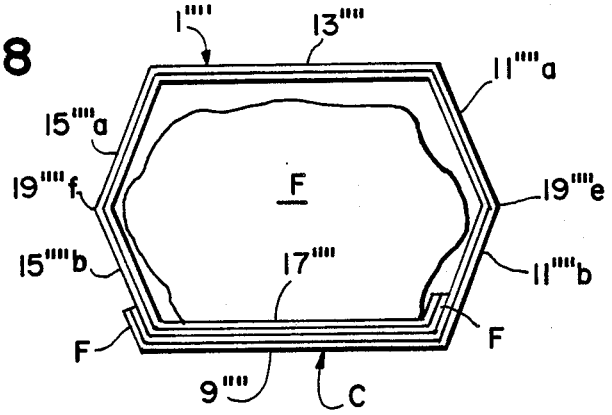
FIG. 8 is an end view of another configuration for a microwave interactive heating sleeve in accordance with the present invention with a food item therein.

FIG. 8 depicts another modified sleeve embodiment 1'''' which is designed to enable the sleeve to more closely conform to the peripheral contour of irregularly shaped food objects F. That is, in comparison to a sleeve as shown in FIG. 4, the side sections 11, 15 have been subdivided by additional fold lines 19''''*e*, 19''''*f* into half sections 11''''*a*, 11''''*b*, and 15''''*a*, 15''''*b*. Another feature embodied in the FIG. 8 sleeve 1'''' is the provision of glue flaps F which may be used, in addition to or instead of the overlapped panel sections 19'''', 17'''' to adhesively join together opposite end portions of an elongated blank into the sleeve 1''''.

Figure 9:
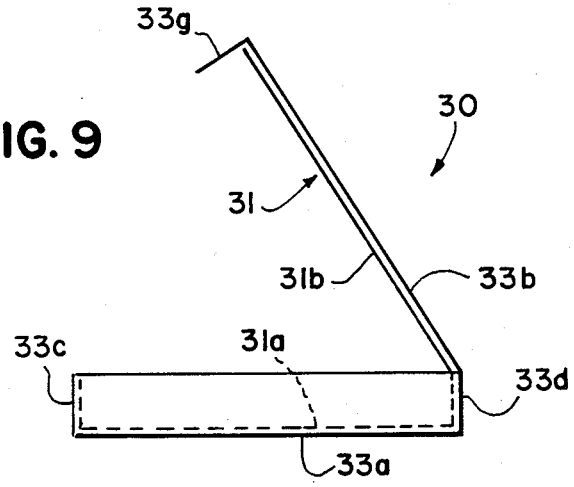
FIG. 9 is a diagrammatic depiction of a carton embodiment in accordance with the present invention.

While, to this point, the present invention has been described exclusively with respect to embodiments in the form of open-ended tubular sleeves, it should be appreciated that the invention is not so limited. In FIG. 9, an embodiment is shown wherein the above-described concepts are incorporated into a paperboard carton 30 having at least one primary panel wall section which, as depicted in this illustrative embodiment, may form a sleeve-like lining 31 for a carton of otherwise conventional construction.

Figure 10:
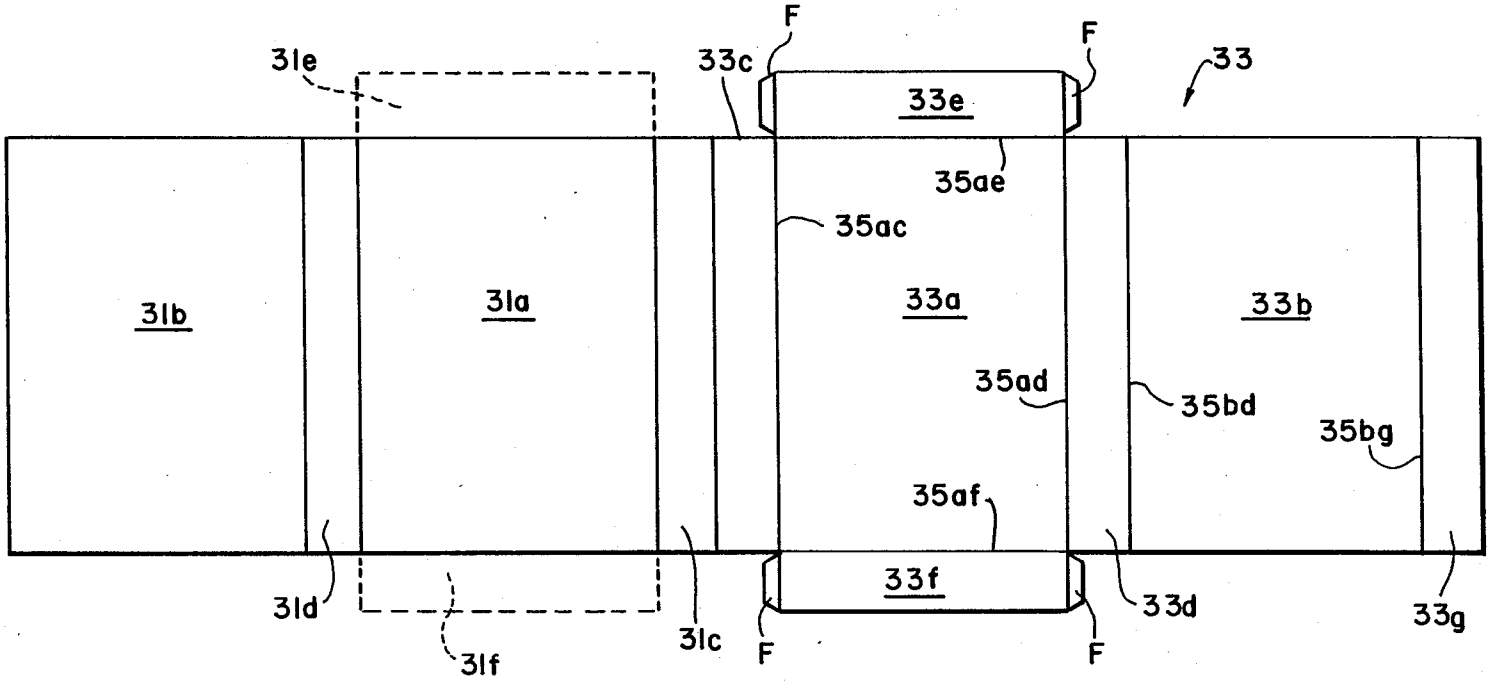
FIG. 10 is a plan view of a blank for use in forming the FIG. 9 carton.

In particular, with reference to FIG. 10, a blank 33 is shown as one way in which a carton 30 can be formed with an integral liner 31. The carton forming portion of the illustrated blank 33 is comprised of seven sections which include first and second polygonal main wall sections 33*a*, 33*b*, four side wall sections 33*c*–33*f*, that are connected to each edge of the first main wall section 33*a* by fold lines 35*ac*–35*af*, respectively, and a closure section 33*g*. The second polygonal main wall section 33*b* is joined to side wall section 33*d* by a fold line 35*bd*, so that when the blank is erected to form carton 30 (glue flaps F being shown for securing the side walls together, but lock type flaps for interlocking in a slot of the adjoining side wall section may be used), the first and second main wall sections 33*a*, 33*b* are disposed in facing relationship to each other with the side wall sections 33*c*–33*f* extending therebetween to define an object receiving space. The closure wall 33*g* is attached at an edge of the second main wall section 33*b* by a fold line 35*bg*, so that, in use, it will overlap the exterior of side wall section 33*c* and which it may be adhesively secured for sealing of a food object within the carton for shipping and storage purposes. This closure section 33*g* may be constructed to provide a zip-strip type, tear-open closure to facilitate opening of the carton.

As can be seen from FIGS. 9 and 10, the liner portions of blank 33 is divided by fold lines into sections 31*a*–31*d* that are essentially matched to the corresponding wall sections 33*a*–33*d* of the carton forming section. Side wall section 31*c* is connected by a fold line to the side wall section 33*c* that is disposed on the opposite side of the first main wall section 33*a* from the side wall section 33*d* that is connected to the cover-forming, second main wall section 33*b*. As a result, in the in-use configuration of FIG. 9, each of the wall sections of the liner portion is disposed in superimposed overlapping relationship with respect to a corresponding wall section of the carton portion. Thus, in dependence upon the nature of the particular food object to be heated within the surface heating apparatus formed by carton 30, any or all of the surfaces of the wall sections which face the interior of the carton 30 may have microwave interactive heater material applied thereover so that one or more contact walls, which correspond to the contact walls C of the earlier mentioned sleeve embodiments, can be produced. With respect to such contact walls, it should be apparent that a primary panel wall section will be formed by each liner section that is covered with microwave interactive heater material and overlies a carton portion wall section that is similarly covered with a microwave interactive heater material to form a secondary panel wall section.

Furthermore, it should be appreciated that the focused heater material concept shown for section 17″ in FIG. 6 may be utilized in conjunction with the layers of heater material applied to any sections of either of the carton portion or liner portion, while the configured section concept shown for sleeve section 17‴ of FIG. 7 is applicable to wall sections of the liner portion only. In any case, the covering of heater material applied to any wall section will typically be at least as great as the object heating area as initially defined in the "Disclosure of the Invention" section.

Figure 11:
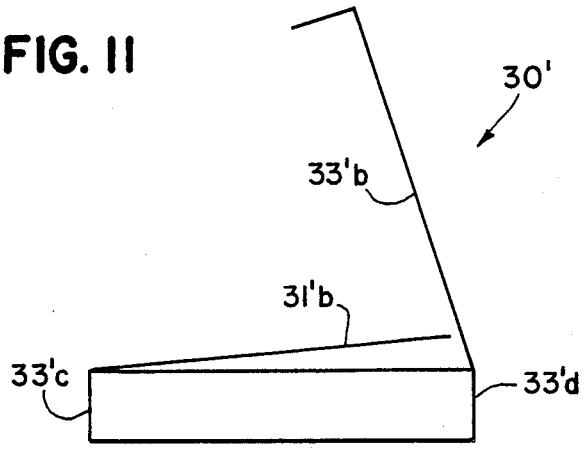
FIG. 11 is a diagrammatic illustration of a modified carton embodiment in accordance with another preferred embodiment of the present invention.

Other modifications that can be made to carton 30 include the fact that, as reflected by broken lines in FIG. 10, side sections 31*e* and 31*f* can be connected by fold lines to the opposite sides of wall section 31*a* of the liner portion in order that the end wall sections 33*e* and 33*f* also may be made into double heater contact walls. Alternatively, as reflected by the modified embodiment of a carton 30′ illustrated in FIG. 11, a single primary panel forming wall section 31′*b* can be joined to the side wall section 33′*c* that is disposed opposite the wall section 33′*d* to which the main wall section 33′*b* is connected. Thus, upon sealing of the carton, liner wall section 31′*b* will be disposed in overlapping relationship to the main wall section 33′*b* to form primary and secondary panel wall sections of a contact wall. Such a contact wall at the top of a carton can be useful with respect to food objects requiring browning or crispening at only a top surface thereof, such as for pot pies, or, by inverting of the carton, can form a bottom browning contact wall for food objects, such as pizzas, which require browning and crispening only at a bottom surface thereof. Of course, a primary panel as is formed by wall section 31′*b* may have a focused covering of heater material, as with the embodiment of FIG. 6, or may be configured to the object heating area, as done for the embodiment of FIG. 7.

While normally it is desired to minimize the number of pieces per package which must be handled by the packer, in some cases the use of a separate heater insert may be preferable and/or more advantageous than an integrally formed one. For example, in situations where stacked heater layers are to be used in conjunction with trays or containers that are made from materials that will melt when the heater structure is in contact therewith, such as trays or containers formed of thin plastic materials, a heater insert as illustrated in FIG. 12 can be advantageously utilized.

Figure 12:
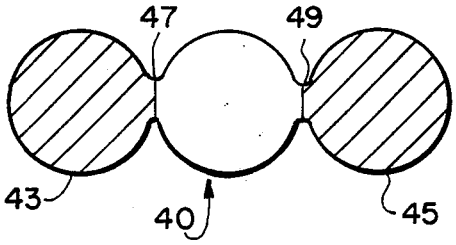
FIG. 12 is a plan view of a blank for use in producing a planar browning insert element in accordance with another embodiment of the present invention.

In FIG. 12, an apparatus for surface heating of an object in an oven by microwave energy in the form of a disk-like insert 40 is shown that is formed of a paperboard blank having an insulating section 41 that is free of microwave interactive heater material and to which sections 43 and 45 of the blank are connected in a hinge-like manner by fold lines 47, 49. The fold lines 47, 49 enable, for example, section 43 to be folded on top of section 41 and section 45 on top of section 43 to create the stacked configuration illustrated in FIG. 13, wherein the layers of heater material H face upwardly, while the paperboard layers B of sections 43, 45 face downwardly toward section 41. However, a triple heating layer arrangement can be created by applying microwave interactive heater material H to section 41 at the opposite side of the blank from that having the heater material for sections 43, 45, so that, in the FIG. 13 configuration, all of the layers of heater material H will face in the same direction (this optional layer H being designated by a broken arrow in FIG. 13).

Figure 13:
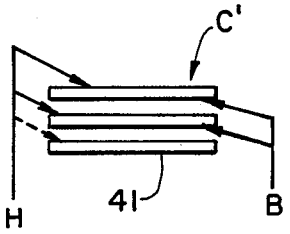
FIG. 13 is a diagrammatic exploded view of the FIG. 12 blank in its in-use configuration.
Figure 14:
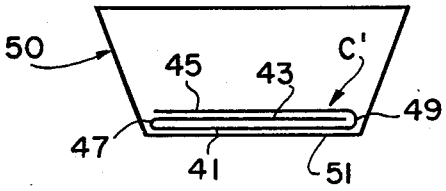
FIG. 14 is a diagrammatic depiction of use of a planar browning insert formed from the blank of FIG. 12.

An insert apparatus 40, as described relative to FIGS. 12 and 13, may be packaged, for example, in a carton with, for example, a package of vegetables (with or without flavoring or sauce ingredients), as well as a thin plastic tray 50 (FIG. 14). A consumer can then easily follow instructions for folding of the insert apparatus 40 into a contact wall C′ to be disposed with insulating section 41 protectively resting upon the bottom wall 51 of the tray 50, after which the food ingredients can be added to the tray and heated in a microwave oven in accordance with prescribed cooking directions. The contact wall C′ will ensure that the vegetables are rapidly exposed to a high enough conductive heating surface to produce a crisp food texture, despite the fact that a microwave oven is utilized, and without concern for scorching, burning or melting of the thin plastic tray 50.

From the foregoing, it should now be apparent how the present invention provides a means for enhanced microwave cooking using multiple stacked surfaces of interactive heater material, with or without supportive insulation. Furthermore, it should be recognized that the above described embodiments are merely illustrative in nature and that those skilled in the art should readily perceive how aspects of one embodiment may be substituted or added to other embodiments, as well as the virtually limitless application of the inventive concepts to package types and package inserts beyond those illustrated. Therefore, since the present invention is susceptible to numerous changes, modifications, and variations that will have become apparent to those skilled in the art from the foregoing disclosure, the present invention should not be considered to be limited to the details shown and described herein, but rather encompasses all such changes, modifications, and variations as are within the scope of the appended claims.

Industrial Applicability

The present invention has particular utility in the packaging of food products for distribution and sale in refrigerated and frozen display cases for cooking in a household microwave oven. However, the present invention will be applicable to the heating of any object in a microwave oven to produce a result, such as browning and crispening of one or more surfaces of a food object, where the heat generated by a single layer of microwave interactive heater material will not heat to a high enough temperature.

We claim:

1. An apparatus for surface heating an object in an oven by microwave energy, comprising:

(a) microwave interactive heating means for surface heating the object by converting microwave energy to heat; and (b) support means for supporting said microwave interactive heating means and for engaging the object to be surface heated by the microwave interactive heating means, said support means having at least one contact wall with a contact surface against which the object is disposed;

wherein said at least one contact wall is comprised of at primary panel which defines said contact surface and a secondary panel which is coextensive in area with at least an object heating portion of said primary panel and which is disposed adjacent to said primary panel at an opposite side thereof from said contact surface; and wherein said microwave interactive heating means comprises a first layer of microwave interactive heater material that is applied to said primary panel covering at least the object heating portion thereof, and a second layer of microwave interactive heater material applied to said secondary panel covering at least a part of a facing surface thereof that is directed toward said primary panel, said part of said facing surface being substantially coextensive with at least said object heating portion of the primary panel; and wherein said primary panel and said second panel are both formed by unitary sections of a single paperboard blank, said paperboard blank carrying only a single layer of microwave interactive heater material.

2. Apparatus according to claim 1, wherein said blank is comprised of at least five sections, each section being connected to an adjoining section by a fold line, and wherein the sections forming the primary panel and secondary panel are disposed relative to each other in a manner enabling them to be brought into a superimposed relationship forming said contact wall by folding of said blank about said fold lines.

3. Apparatus according to claim 2, wherein said blank is formed into a sleeve by folding thereof about said fold lines so as to bring at least opposite end sections of said blank into overlapping relationship to form the contact wall.

4. Apparatus according to claim 3, wherein the overlapping sections are adhesively connected together.

5. Apparatus according to claim 3, wherein only the opposite end sections of the blank are overlapped to form the contact wall, and wherein said contact wall forms a bottom wall of the sleeve.

6. Apparatus according to claim 5, wherein the overlapping sections are adhesively connected together.

7. Apparatus according to claim 3, wherein an entire side of said blank, which faces inwardly when formed into said sleeve, is covered by said microwave interactive heater material; wherein the object heating portion of the primary panel of the contact wall formed by the overlapping end sections has a shape that is smaller in area than the contact wall; and wherein one of said end sections has a shape that conforms essentially to the shape of the object heating portion except for a connecting hinge portion thereof.

8. Apparatus according to claim 3, wherein the object heating portion of the primary panel has a shape that is smaller in area than the contact wall; and wherein at least one of said primary panel and said secondary panel has a focused covering of said microwave interactive heater material that conforms essentially to the shape of said object heating portion.

9. Apparatus according to claim 2, wherein said blank is comprised of at least seven sections which include first and second polygonal main wall sections, a side wall section situated at each edge of said first main wall section, and a primary panel wall section joined to one of said side wall sections at an edge of said one of the side wall sections that is disposed on an opposite side thereof from said first main wall section; wherein said blank is erectable into a carton having said first and second main wall sections disposed in facing relationship to each other with said side wall sections extending therebetween to define an object receiving space, and having said primary panel wall section disposed in overlapping relationship to an inner side of one of the wall sections that define the object receiving space; and wherein said primary panel wall section and the wall section overlapped thereby form the primary panel and secondary panel of a said contact wall.

10. Apparatus according to claim 9, wherein the wall section overlapped by the primary panel wall section, in the erected condition of the blank, is said second main wall section.

11. Apparatus according to claim 9, wherein the wall section overlapped by the primary panel wall section is the side wall section to which it is joined; and wherein additional primary panel wall sections are provided in a manner for forming additional said contact walls in conjunction with respective other of the wall sections defining the object receiving space.

12. Apparatus according to claim 11, wherein said additional primary panel wall sections include a first additional primary panel wall section connected to an edge of said primary panel wall section by a fold line and at least one other additional primary panel section that is connected to the first additional primary panel wall section.

13. Apparatus according to claim 11, wherein the other of the wall sections defining the object receiving space that form the additional said contact walls with the additional primary panel wall sections comprise the first and second main wall sections and at least another one of the side wall sections.

14. Apparatus according to claim 13, wherein the wall sections forming at least one of the contact walls are adhesively connected together.

15. Apparatus according to claim 2, wherein folding of the blank places plural sections thereof in overlapping relationship for providing said sleeve with a corresponding number of contact walls.

16. Apparatus according to claim 15, wherein at least one of the overlapping sections are adhesively connected together.

17. Apparatus according to claim 15, wherein a plurality of said overlapping sections are adhesively connected together.

18. Apparatus according to claim 1, wherein said paperboard blank comprises an insulating section that is free of microwave interactive heater material; and wherein the sections of the blank forming the primary panel and the secondary panel of the contact wall are connected together with said insulating section in a hinge-like manner by fold line means for enabling the primary panel to be stacked upon the secondary panel at one side of the insulating section.

19. Apparatus according to claim 18, wherein each of said sections has a disc-like shape; wherein microwave interactive heater material completely covers the sections forming the primary and secondary panels at the same side of said blank; and wherein said insulating section is connected between the sections forming the primary and secondary panels.

20. An apparatus for surface heating an object in an oven by microwave energy, comprising:

(a) microwave interactive heating means for surface heating the object by converting microwave energy to heat; and (b) support means for supporting said microwave interactive heating means and for engaging the object to be surface heated by the microwave interactive heating means, said support means having at least one contact wall with a contact surface against which the object is disposed;

wherein said at least one contact wall is comprised of a primary panel which defines said contact surface and a secondary panel which is coextensive in area with at least an object heating portion of said primary panel and which is disposed adjacent to said primary panel at an opposite side thereof from said contact surface; wherein said microwave interactive heating means comprises a first layer of microwave interactive heater material that is applied to said primary panel covering at least the object heating portion thereof at said contact surface, and a second layer of microwave interactive heater material applied to said secondary panel covering at least a part of a facing surface thereof that is directed toward said primary panel, said part of said facing surface being substantially coextensive with at least said object heating portion of the primary panel, and wherein said first and second layers of interactive heater material are separated by a layer of insulative paperboard of which said primary panel is comprised.

21. Apparatus according to claim 20, wherein said primary panel and said secondary panel are both formed by unitary sections of a single paperboard blank.

22. Apparatus according to claim 21, wherein said blank is formed into a sleeve by folding thereof about said fold lines so as to bring at least opposite end sections of said blank into overlapping relationship to form the contact wall.

23. Apparatus according to claim 22, wherein an entire side of said blank, which faces inwardly when formed into said sleeve, is covered by said microwave interactive heater material; wherein the object heating portion of the primary panel of the contact wall formed by the overlapping end sections has a shape that is smaller in area than the contact wall; and wherein one of said end sections has a shape that conforms essentially to the shape of the object heating portion except for a connecting hinge portion thereof.

24. Apparatus according to claim 22, wherein the object heating portion of the primary panel has a shape that is smaller in area than the contact wall; and wherein at least one of said primary panel and said secondary panel has a focused covering of said microwave interactive heater material that conforms essentially to the shape of said object heating portion.

25. Apparatus according to claim 21, wherein said blank is comprised of at least seven sections which include first and second polygonal main wall sections, a side wall section situated at each edge of said first main wall section, and a primary panel wall section joined to one of said side wall sections at an edge of said one of the side wall sections that is disposed on an opposite side thereof from said first main wall section; wherein said blank is erectable into a carton having said first and second main wall sections disposed in facing relationship to each other with said side wall sections extending therebetween to define an object receiving space, and having said primary panel wall section disposed in overlapping relationship to an inner side of one of the wall sections that define the object receiving space; and wherein said primary panel wall section and the wall section overlapped thereby form the primary panel and secondary panel of a said contact wall.

26. Apparatus according to claim 21, wherein said paperboard blank comprises an insulating section that is free of microwave interactive heater material; and wherein the sections of the blank forming the primary panel and the secondary panel of the contact wall are connected together with said insulating section in a hinge-like manner by fold line means for enabling the primary panel to be stacked upon the secondary panel at one side of the insulating section.

* * * * *